US005506593A

United States Patent [19]

Peng

[11] Patent Number: 5,506,593

[45] Date of Patent: Apr. 9, 1996

[54] ANTENNA PROTECTING DEVICE FOR MOTOR VEHICLES

[76] Inventor: Jung-Ching Peng, P.O. Box 82-144, Taipei, Taiwan

[21] Appl. No.: 390,781

[22] Filed: Feb. 17, 1995

[51] Int. Cl.[6] ..... H01Q 1/32; H01Q 1/12

[52] U.S. Cl. ..... 343/888; 343/715; 343/882

[58] Field of Search ..... 343/715, 888, 343/882, 880, 878, 892, 900, 902, 711; H01Q 1/32, 1/12

[56] References Cited

U.S. PATENT DOCUMENTS

| | | | |
|---|---|---|---|
| 5,184,142 | 2/1993 | Hornburg et al. | 343/715 |
| 5,221,929 | 6/1993 | Ott | 343/715 |
| 5,248,986 | 9/1993 | Marshall | 343/715 |

*Primary Examiner*—Donald T. Hajec
*Assistant Examiner*—Hoanganh Le
*Attorney, Agent, or Firm*—Alfred Lei

[57] ABSTRACT

An antenna protecting device for motor vehicles including a triangular base made of magnetic conducting material, a gourd-shaped container having a small spherical portion at an upper part, a large spherical portion at a lower part, and a neck portion between the small and large spherical portions, the neck portion being rotatably connected with the triangular base, a bracket extending upwardly from a top of the small spherical portion of the gourd-shaped container and having a platform at an upper end, a screw being threadedly engaged with the platform of the bracket and extending downwardly into the spherical portion of the gourd-shaped container, a ball disposed within the small spherical portion of the gourd-shaped container and connected with a lower end of the screw via a chain, a circular seat arranged with a bottom of the large spherical portion of the gourd-shaped container, a magnet fitted in the circular seat, a protective rod fixedly mounted on the platform of the bracket, and an antenna connected with the platform of the bracket.

1 Claim, 4 Drawing Sheets

ANTENNA PROTECTING DEVICE FOR MOTOR VEHICLES

BACKGROUND OF THE INVENTION

It has been found that the conventional antenna for motor vehicles is provided with no protective means thereby rendering it easily damaged when meeting with an obstacle such as trees, signs, or the like.

Therefore, it is an object of the present invention to provide a protecting device which can effectively prevent the antenna from being damaged.

SUMMARY OF THE INVENTION

This invention relates to an antenna protecting device.

It is the primary object of the present invention to provide an antenna protecting device which can prevent the antenna from being damaged.

It is another object of the present invention to provide an antenna protecting device which is simple in construction.

It is still another object of the present invention to provide an antenna protecting device which is low in cost.

It is still another object of the present invention to provide an antenna protecting device which is fit for practical use.

It is a further object of the present invention to provide an antenna protecting device which is economic to produce.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
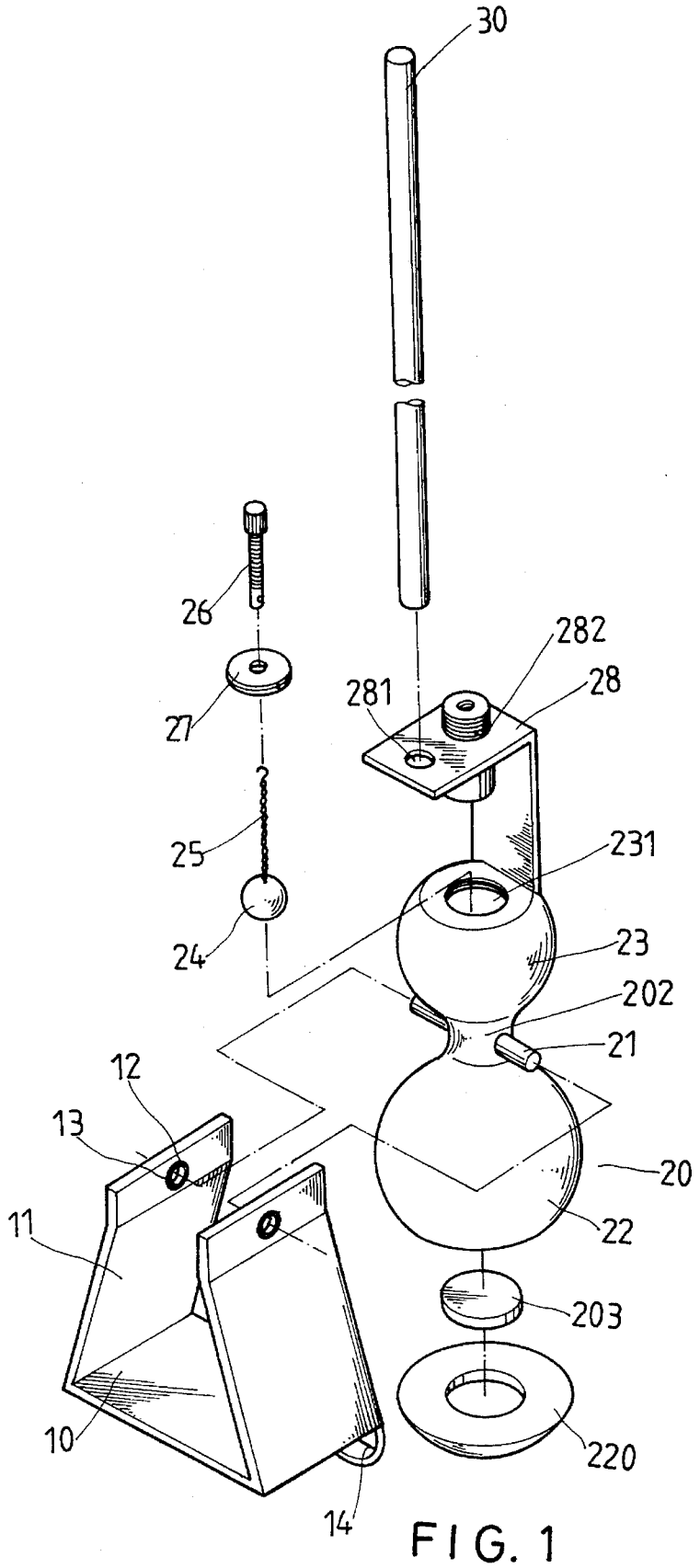
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figures 2, 2A:
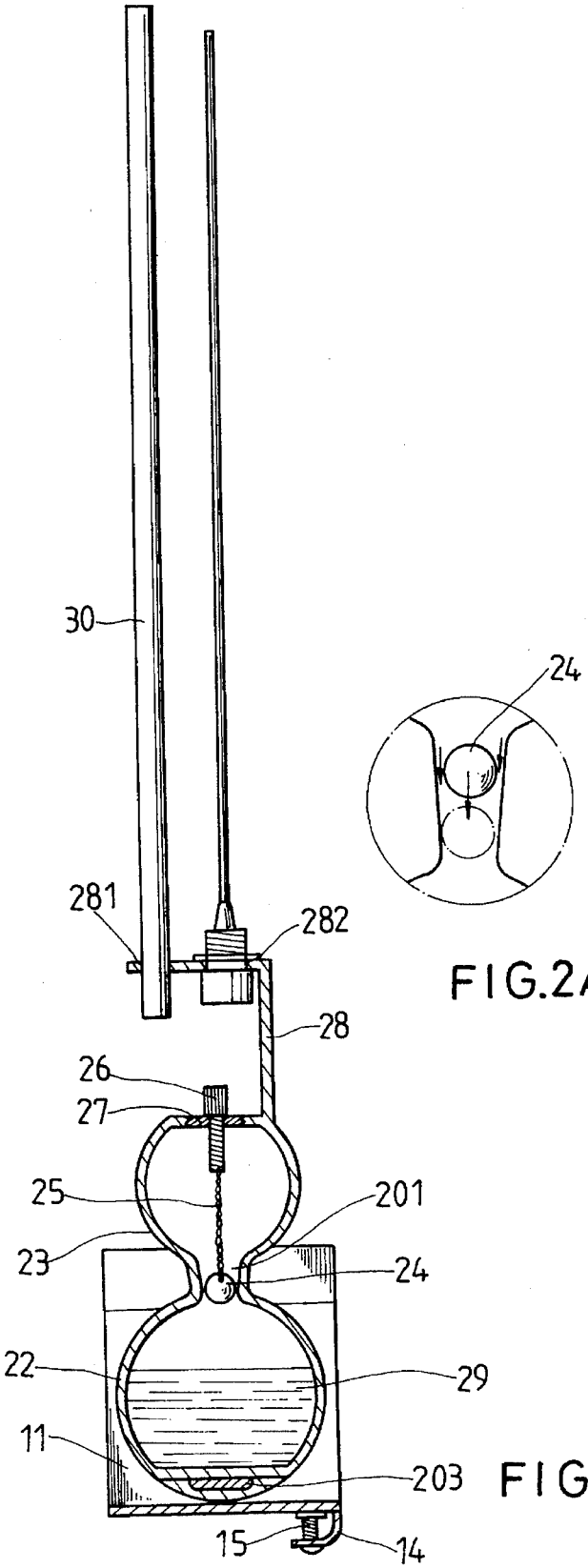
FIG. 2 is a sectional view of the present invention.
FIG. 2A shows the engagement between the ball and the neck of the gourd-shaped container.
Figure 4:
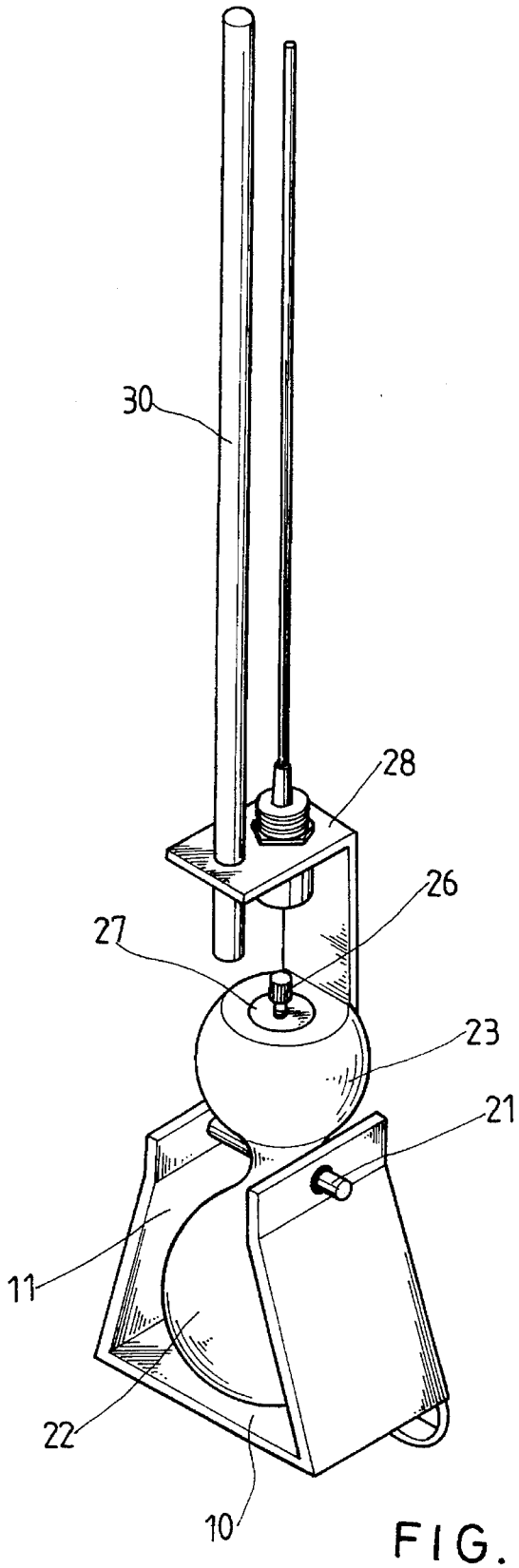
FIG. 4 is a perspective view of the present invention.

With reference to the drawings and in particular to FIGS. 1, 2 and 4 thereof, the antenna protecting device according to the present invention mainly comprises a triangular base 10, a gourd-shaped container 20, and a protective rod 30.

As illustrated, the triangular base 10 is made of magnetic conducting material such as iron or the like and has two upwardly extending sides 11. The upper edges of the two sides 11 are separated by a gap and formed with a hole 12 in which is fitted a bearing 13. The gourd-shaped container 20 is provided with two opposite rod members 21 at the neck portion which are adapted to the holes 12 of triangular base 10 so that the gourd 20 can be freely swung with respect to the triangular base 10.

The gourd-shaped container 20 includes a small spherical portion 23 at the upper part and a large spherical portion 22 at the lower part. The large spherical portion 22 is used for receiving liquid. The small spherical portion 23 has an opening 231 at the top and a bracket 28 upwardly extending therefrom. The bracket 28 is provided with a platform having a hole 281 and a threaded connector 282. A plug 27 is threadedly engaged with the opening 231 of the gourd-shaped container 20. A screw 26 is threadedly engaged with the plug 27 and extends downwardly into the small spherical portion 22 of the gourd-shaped container 20. A ball 24 is connected with the lower end of the screw 26 via a chain 25 so that the ball 24 can be adjusted in position by regulating the screw 26. The protective rod 30 is fixedly fitted in the hole 281 of the bracket 28. The threaded connector 282 is used to engage with an antenna (shown but not numbered). A seat 220 is arranged within the large spherical portion 22 of the gourd-shaped container 20 and has a recess for receiving a magnet 203 for attracting the triangular base 10 so as to keep the gourd-shaped container 20 at a steady condition.

Figure 3:
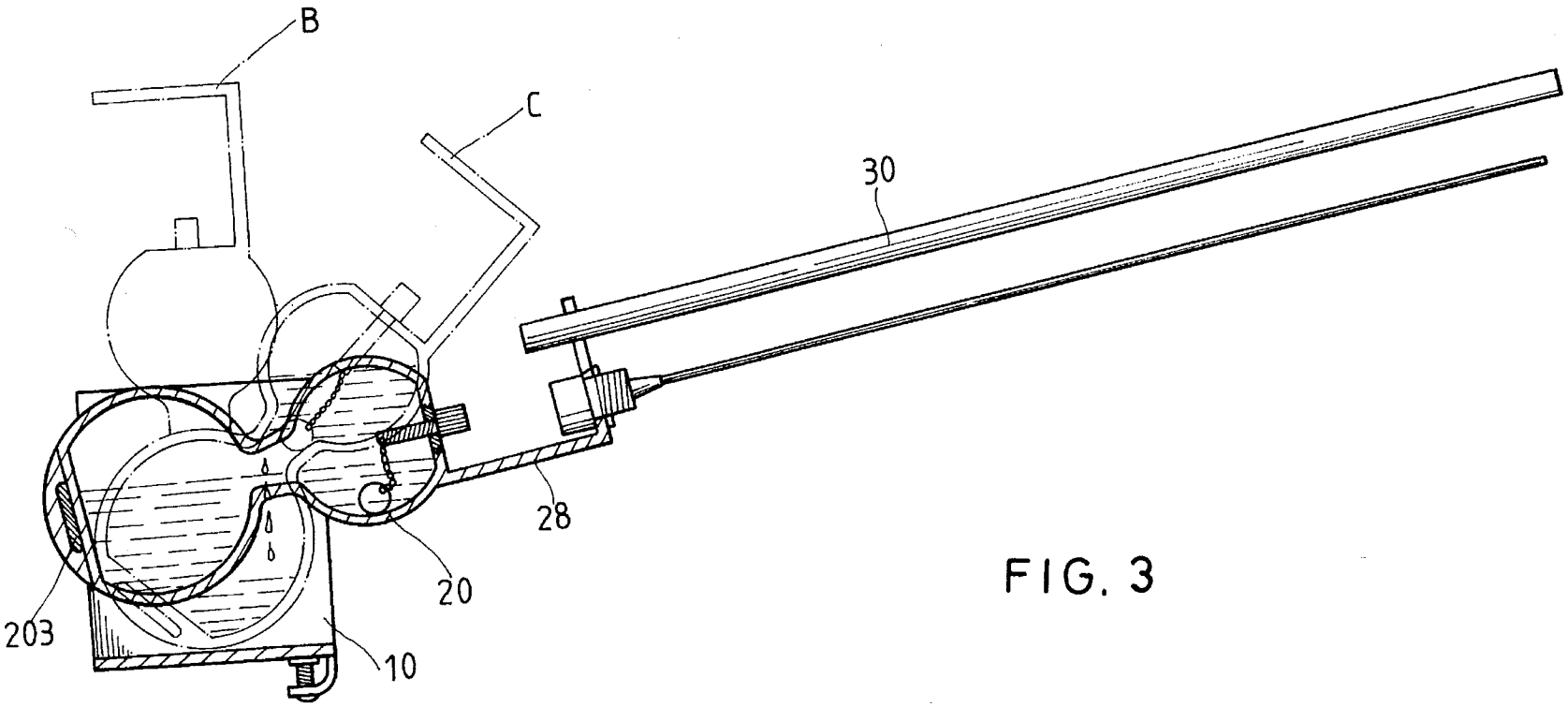
FIG. 3 is a working view of the present invention.

Looking now at FIG. 3, when the protective rod 30 meets with an obstacle (not shown) thereby rotating in clockwise direction, the gourd-shaped container 20 will be pushed to rotate with respect to the rod members 21 in clockwise direction too. In the meantime, the liquid in the large spherical portion 22 of the gourd-shaped container 20 will flow into the small spherical portion 23 of the gourd-shaped container 20. As the protective rod 30 is no longer blocked by the obstacle, the liquid will flow back into the large spherical portion 22 of the gourd-shaped container 20 and the magnet 203 will attract the triangular base 10 thereby returning the gourd-shaped container 10 to its original position.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An antenna protecting device for motor vehicles comprising:

a triangular base made of magnetic conducting material;

a gourd-shaped container having a small spherical portion at an upper part, a large spherical portion at a lower part, and a neck portion between the small and large spherical portions, said neck portion being rotatably connected with said triangular base;

a bracket extending upwardly from a top of the small spherical portion of said gourd-shaped container and having a platform at an upper end;

a screw being threadedly engaged with the platform of said bracket and extending downwardly into the spherical portion of said gourd-shaped container;

a ball disposed within the small spherical portion of said gourd-shaped container and connected with a lower end of said screw via a chain;

a circular seat arranged with a bottom of the large spherical portion of said gourd-shaped container;

a magnet fitted in said circular seat;

a protective rod fixedly mounted on the platform of said bracket; and an antenna connected with the platform of said bracket.

* * * * *